US012012194B2

(12) United States Patent
Mizutani et al.

(10) Patent No.: US 12,012,194 B2
(45) Date of Patent: Jun. 18, 2024

(54) OUTBOARD MOTOR

(71) Applicant: YAMAHA HATSUDOKI KABUSHIKI KAISHA, Iwata (JP)

(72) Inventors: Makoto Mizutani, Shizuoka (JP); Tomohiro Hagi, Shizuoka (JP); Chiharu Masuda, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 418 days.

(21) Appl. No.: 17/547,282

(22) Filed: Dec. 10, 2021

(65) Prior Publication Data

US 2022/0194536 A1 Jun. 23, 2022

(30) Foreign Application Priority Data

Dec. 22, 2020 (JP) ..... 2020-212112

(51) Int. Cl.

| | |
|---|---|
| ***B63H 20/02*** | (2006.01) |
| ***B63H 20/10*** | (2006.01) |
| ***B63H 20/12*** | (2006.01) |
| ***B63H 23/34*** | (2006.01) |
| ***B63H 25/42*** | (2006.01) |

(52) U.S. Cl.

CPC ..... *B63H 20/02* (2013.01); *B63H 20/10* (2013.01); *B63H 20/12* (2013.01); *B63H 23/34* (2013.01); *B63H 25/42* (2013.01)

(58) Field of Classification Search

CPC ..... B63H 20/02; B63H 20/10; B63H 20/12; B63H 23/34; B63H 25/42; B63H 20/08

See application file for complete search history.

(56) References Cited

U.S. PATENT DOCUMENTS

| | | | | |
|---|---|---|---|---|
| 3,486,724 | A | 12/1969 | Adamski | |
| 4,954,107 | A * | 9/1990 | Sumigawa | B63H 20/10 248/641 |
| 9,033,752 | B2 * | 5/2015 | Takase | B63H 20/10 440/63 |
| 2009/0170384 | A1 | 7/2009 | Balogh et al. | |
| 2018/0001983 | A1 | 1/2018 | Mizutani | |

FOREIGN PATENT DOCUMENTS

| | | |
|---|---|---|
| JP | 2018-2004 A | 1/2018 |
| SE | 343 809 B | 3/1972 |

OTHER PUBLICATIONS

Official Communication issued in corresponding European Patent Application No. 21200945.0, mailed on Apr. 5, 2022.

* cited by examiner

*Primary Examiner* — Anthony D Wiest
(74) *Attorney, Agent, or Firm* — Keating & Bennett, LLP

(57) ABSTRACT

An outboard motor includes an attachment attached to a hull, and a support vertically rotatably connected to the attachment and horizontally rotatably supporting an outboard motor main unit. The support includes an upper support and a lower support. The outboard motor includes a left reinforcement that includes a left upper connector connected to the upper support and a left lower connector connected to the lower support, and a right reinforcement that includes a right upper connector connected to the upper support and a right lower connector connected to the lower support. The left upper connector is located leftward of a left side of the upper support. The right upper connector is located rightward of a right side of the upper support.

12 Claims, 9 Drawing Sheets

OUTBOARD MOTOR

CROSS REFERENCE TO RELATED APPLICATIONS

This application claims the benefit of priority to Japanese Patent Application No. 2020-212112 filed on Dec. 22, 2020. The entire contents of this application are hereby incorporated herein by reference.

BACKGROUND OF THE INVENTION

1. Field of the Invention

The present invention relates to an outboard motor.

2. Description of the Related Art

There are conventional outboard motors known in the art that include an outboard motor main unit having an engine and a propulsion unit, an attachment member attached to a hull, and a support member steerably supporting the outboard motor main unit on the attachment member. For example, JP A 2018-2004 discloses such an outboard motor. The engine and the propulsion unit of the outboard motor main unit are linked together by a drive shaft extending in the up-down direction.

The support member of the outboard motor disclosed in JP A 2018-2004 includes an upper support portion and a lower support portion that support the outboard motor main unit so as to surround the drive shaft, and a left and a right link portion that link together the upper support portion and the lower support portion. The lower support portion is arranged spaced apart downward from the upper support portion. The left and right link portions are formed in a rod shape extending parallel to the drive shaft.

While navigating a watercraft, a lateral load may be applied to a lower portion of the outboard motor main unit. For example, when the watercraft turns, leftward or rightward water pressure may be applied to the propulsion unit. In such a case, a lateral load is applied to the support member via the outboard motor main unit. With conventional outboard motors, there is a need to increase the size or the weight of the support member in order to increase the mechanical strength against lateral loads.

SUMMARY OF THE INVENTION

Preferred embodiments of the present invention provide outboard motors each having an increased mechanical strength against lateral loads while preventing an increase in size and weight of the support.

An outboard motor according to a preferred embodiment of the present invention includes an outboard motor main unit including an engine, a propulsion unit located below the engine, and a drive shaft connected to the engine and the propulsion unit. The outboard motor includes an attachment to be attached to a hull, and a support vertically rotatably connected to the attachment and horizontally rotatably supporting the outboard motor main unit. The attachment includes a left clamp bracket and a right clamp bracket located rightward of the left clamp bracket. The support includes a left side located rightward of the left clamp bracket and a right side located leftward of the right clamp bracket, and is sandwiched between the left clamp bracket and the right clamp bracket. The outboard motor includes a left tilt shaft that vertically rotatably links together the left side of the support and the left clamp bracket, and a right tilt shaft that vertically rotatably links together the right side of the support and the right clamp bracket. The outboard motor includes a left reinforcement that includes a left upper connector connected to the support and located leftward of the left side of the support, and a left lower connector connected to the support and located below the left upper connector. The outboard motor includes a right reinforcement that includes a right upper connector connected to the support and located rightward of the right side of the support, and a right lower connector connected to the support and located below the right upper connector.

The outboard motor described above includes the left reinforcement and the right reinforcement that reinforce the support. The left upper connector of the left reinforcement is connected to the support at a position leftward of the left side of the support, and the left lower connector thereof is connected to the support at a position below the left upper connector. The right upper connector of the right reinforcement is connected to the support at a position rightward of the right side of the support, and the right lower connector thereof is connected to the support at a position below the right upper connector. With the outboard motor described above, the left reinforcement and the right reinforcement reinforce the left and right sides of the support. Therefore, with the left reinforcement and the right reinforcement, it is possible to efficiently increase the mechanical strength of the support against lateral loads. While a portion of the lateral load applied to the propulsion unit is transmitted to portions of the outboard motor main unit other than the propulsion unit, another portion of the lateral load is transmitted from the support to the hull via the left reinforcement, the right reinforcement, and the attachment. The lateral load applied to the outboard motor main unit is reduced. Therefore, with the outboard motor described above, it is possible to increase the mechanical strength against lateral loads while preventing an increase in size and weight of the support.

According to preferred embodiments of the present invention, it is possible to provide outboard motors each having an increased mechanical strength against lateral loads while preventing an increase in size and weight of the support.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
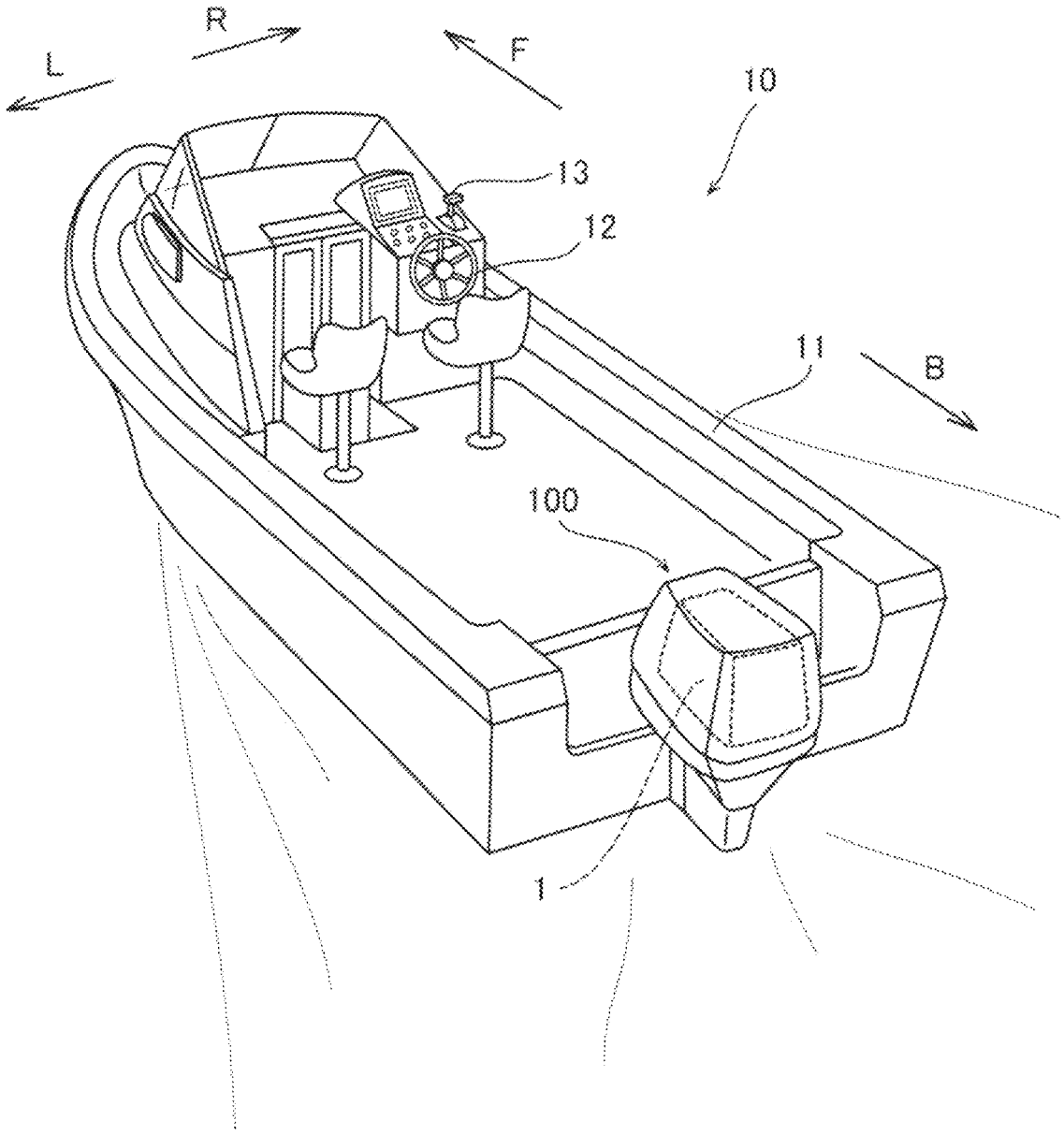
FIG. 1 is a perspective view showing a watercraft including an outboard motor according to a preferred embodiment of the present invention.

Preferred embodiments will now be described with reference to the drawings. FIG. 1 shows a watercraft 10 including an outboard motor 100 according to the present preferred embodiment. The terms front, rear, left, and right, as used in the description below, refers to these directions as viewed facing the forward direction of the watercraft 10, while an axis 7*c* of a drive shaft 7 to be described below extends vertically and the outboard motor 100 is not inclined left and right relative to a hull 11. The designations F, B, L, and R, as used in the figures, refer to front, rear, left, and right, respectively.

The watercraft 10 includes the hull 11, a steering wheel 12, a remote controller 13, and the outboard motor 100. The outboard motor 100 is attached to the rear portion of the hull 11.

The steering wheel 12 steers the hull 11. As the passenger of the watercraft 10 operates the steering wheel 12, the outboard motor 100 rotates leftward or rightward relative to the hull 11. It is possible to shift gears of the outboard motor 100. By operating the remote controller 13, the passenger is able to switch the state of the outboard motor 100 between forward, backward, and neutral. The outboard motor 100 includes an engine 1 including a throttle valve (not shown). By operating the remote controller 13, the passenger is able to adjust the opening of the throttle valve. By adjusting the opening of the throttle valve, it is possible to adjust the output power of the outboard motor 100.

Figure 2:
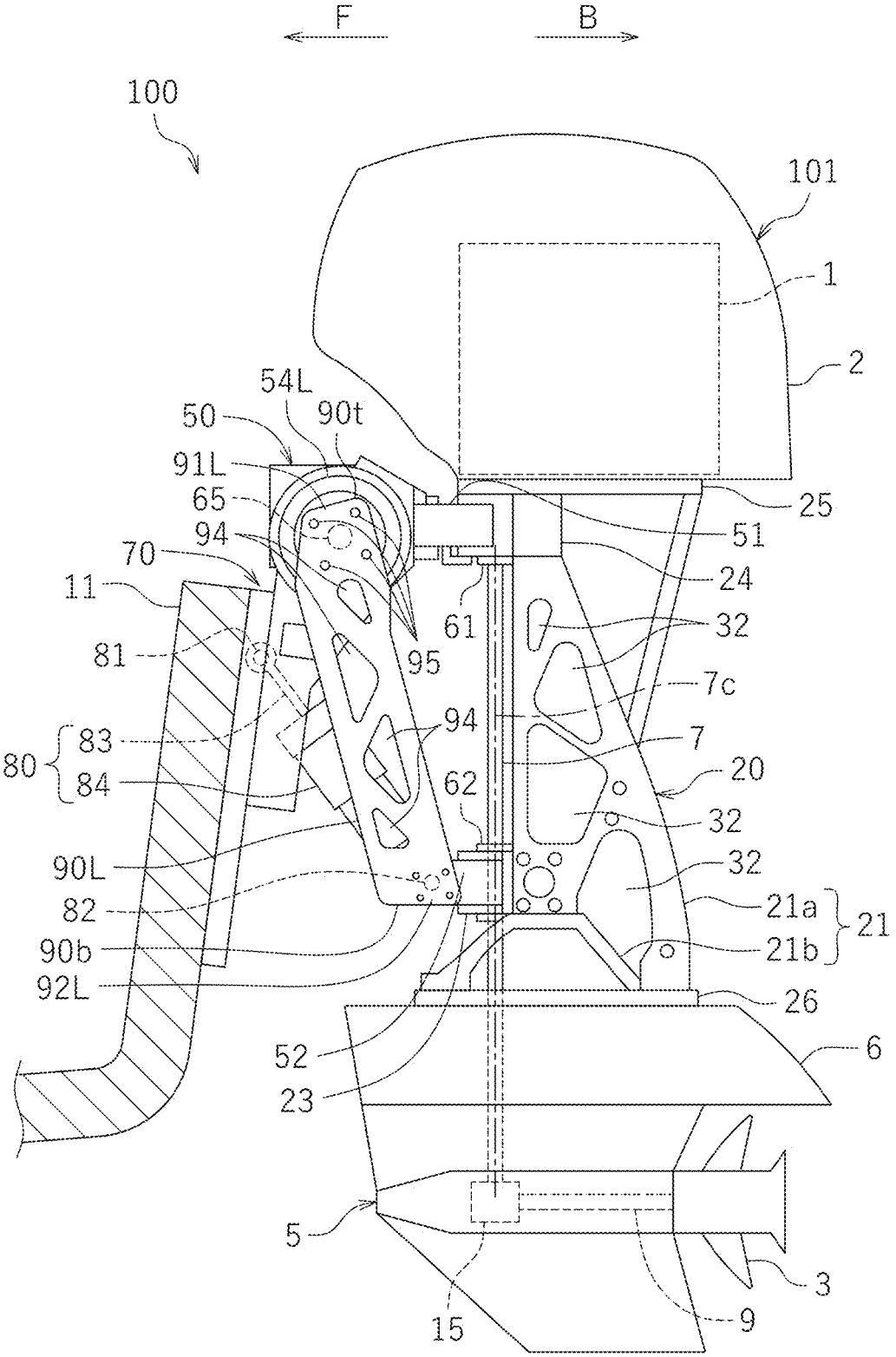
FIG. 2 is a side view showing an outboard motor.

FIG. 2 is a side view showing the outboard motor 100. The outboard motor 100 includes an outboard motor main unit 101, a support member 50 to support the outboard motor main unit 101, and an attachment member 70 to attach the support member 50 to the hull 11.

The outboard motor main unit 101 includes the engine 1, a propulsion unit 5 including a propeller 3, the drive shaft 7 connected to the engine 1 and the propulsion unit 5, and an upper case 20. The engine 1 is located above the upper case 20. The propulsion unit 5 is located below the upper case 20 and is located below the engine 1.

The engine 1 is an internal combustion engine that is driven through combustion of fuel such as gasoline or diesel oil, for example. The engine 1 is covered by a cover 2.

The drive shaft 7 transmits power output from the engine 1 to the propulsion unit 5. The drive shaft 7 extends downward from the engine 1. The drive shaft 7 rotates by being driven by the engine 1.

The propulsion unit 5 includes a propeller shaft 9 on which the propeller 3 is provided, a gear device 15 that links together the drive shaft 7 and the propeller shaft 9, and a lower case 6. The gear device 15 transmits the rotation of the drive shaft 7 to the propeller shaft 9 while decelerating the rotation. Although not shown in the figure, the gear device 15 includes a pinion gear, a forward bevel gear, a backward bevel gear, and a dog clutch. A gear device well known in the art may be suitably used as the gear device 15. The propeller 3 rotates together with the propeller shaft 9, thus generating forward or backward propulsion.

Figure 3:
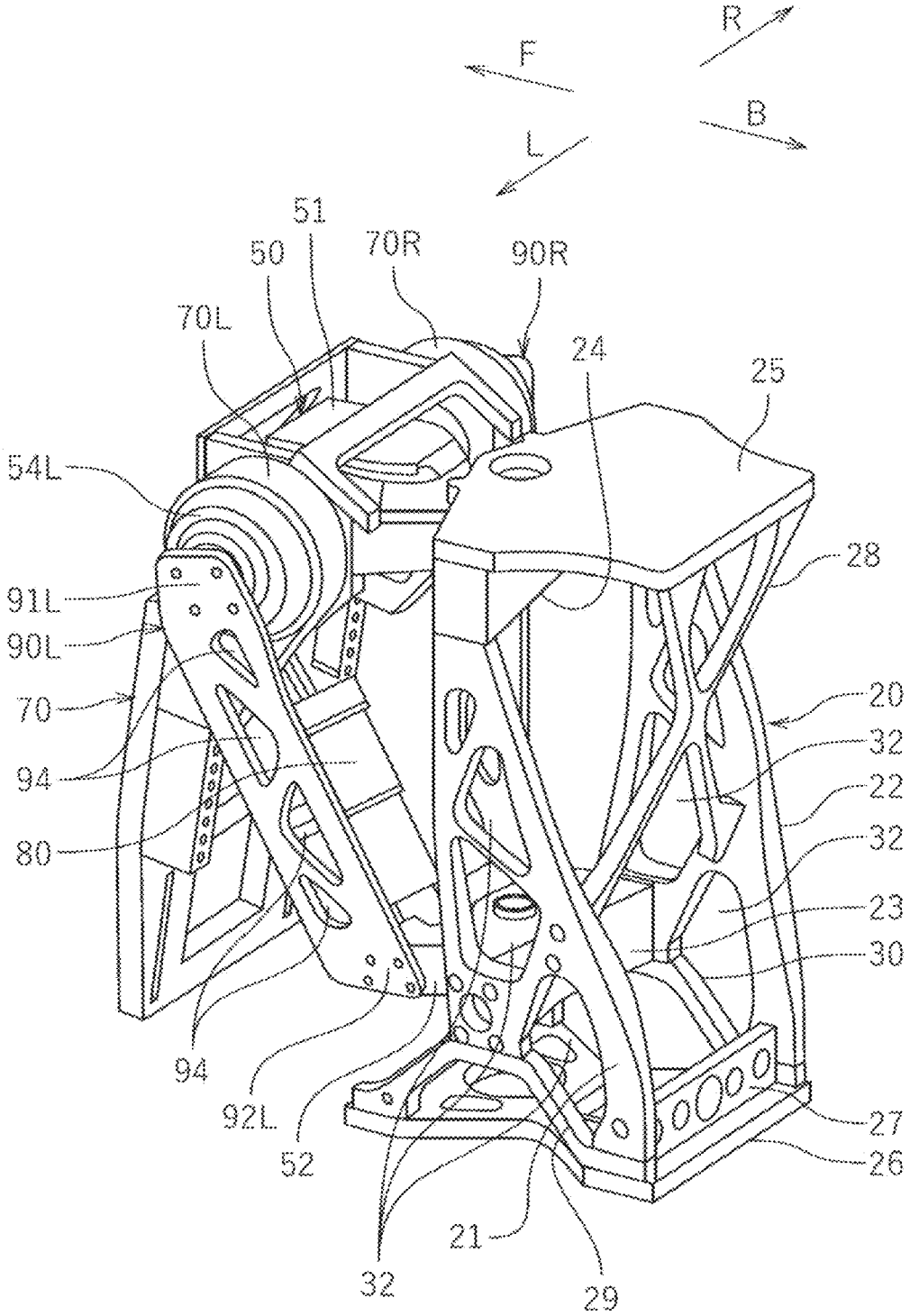
FIG. 3 is a perspective view showing a main portion of the outboard motor.
Figure 4:
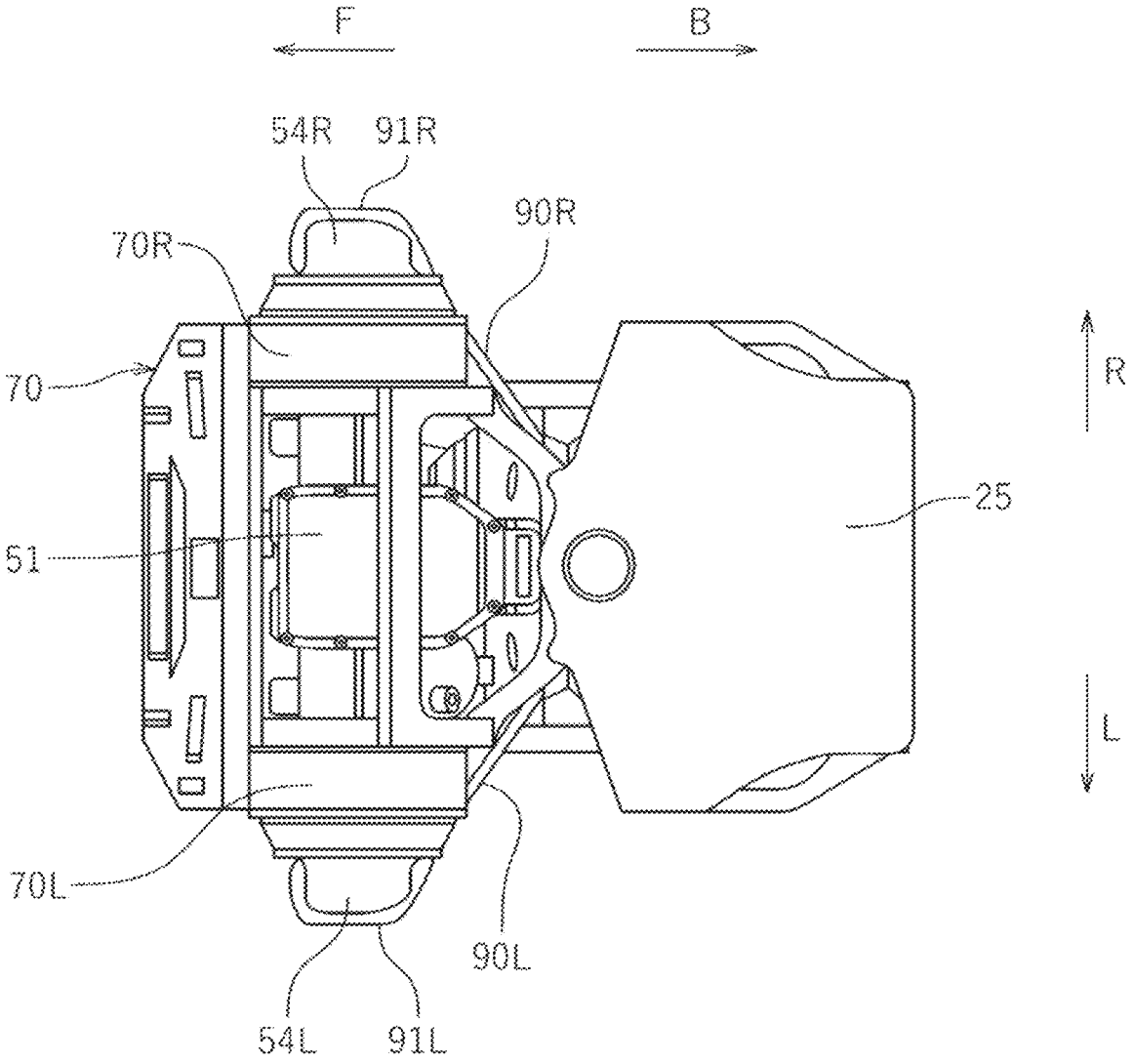
FIG. 4 is a plan view showing the main portion of the outboard motor.
Figure 5:
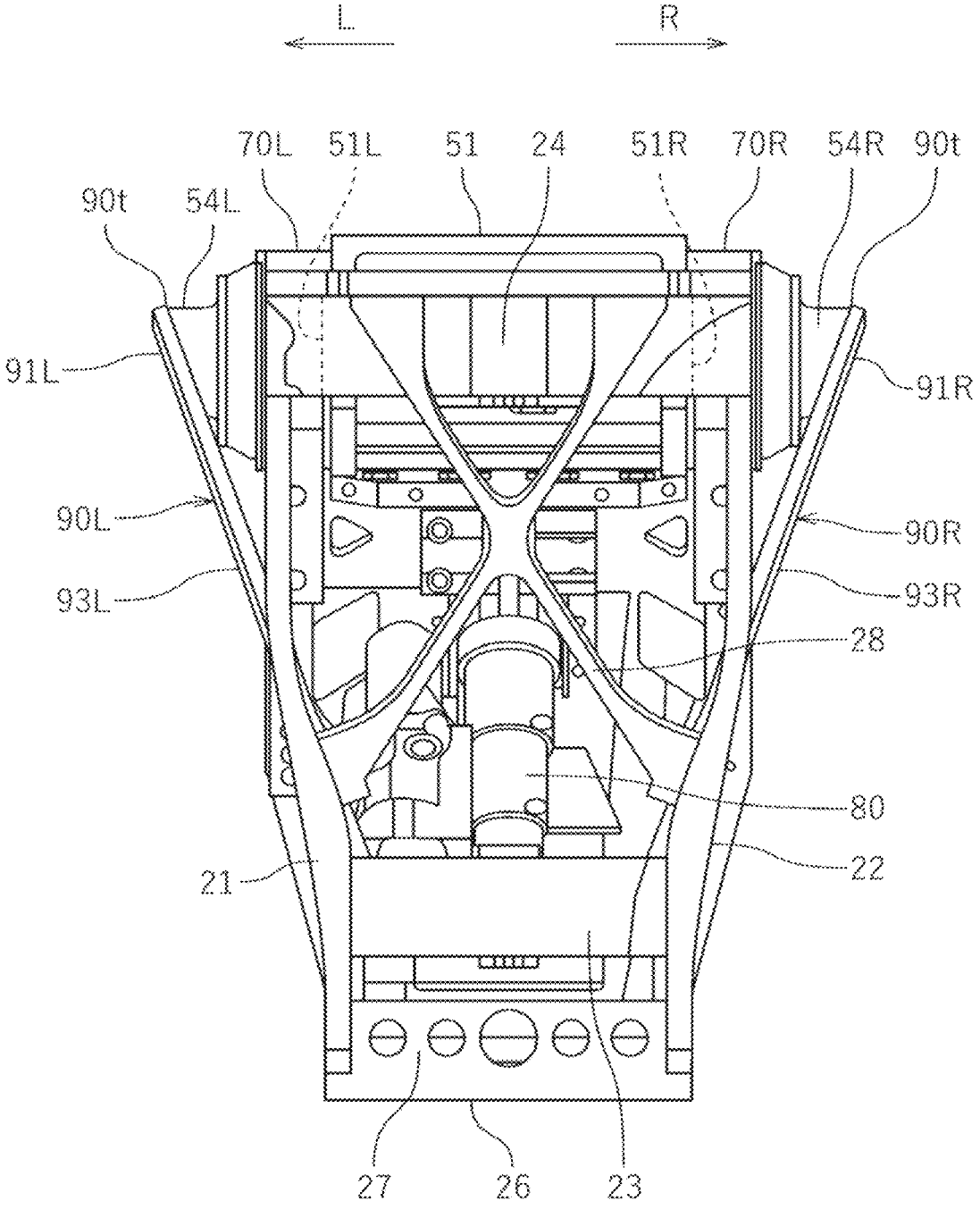
FIG. 5 is a back view showing the main portion of the outboard motor.

FIG. 3 is a perspective view showing the upper case 20, the support member 50, and the attachment member 70. FIG. 4 is a plan view showing the upper case 20, the support member 50, and the attachment member 70. FIG. 5 is a back view showing the upper case 20, the support member 50, and the attachment member 70.

As shown in FIG. 2, the upper case 20 is located between the engine 1 and the propulsion unit 5. The upper case 20 supports the engine 1 and also supports the propulsion unit 5. As shown in FIG. 3, the upper case 20 includes a plurality of case parts 21 to 30. The plurality of case parts 21 to 30 are separate from each other. That is, the plurality of case parts 21 to 30 are separate parts.

The case part 25 and the case part 26 each have a flat plate shape, for example. The case part 26 is located below the case part 25. As shown in FIG. 2, the engine 1 is attached to the case part 25. The propulsion unit 6 is attached to the case part 26.

As shown in FIG. 3, the case part 21 and the case part 22 oppose each other in a direction perpendicular or substantially perpendicular to the axis 7*c* of the drive shaft 7 (see FIG. 2). The drive shaft 7 is located between the case part 21 and the case part 22. In the present preferred embodiment, the case part 22 is located rightward of the case part 21. The case part 21 is located leftward of the drive shaft 7, and the case part 22 is located rightward of the drive shaft 7. Through holes 32 are provided in the case part 21 and the case part 22. The through holes 32 are open in a direction perpendicular or substantially perpendicular to the axis 7*c* of the drive shaft 7. Here, the through holes 32 open leftward and rightward.

The case part 29 is secured to the lower portion of the case part 21. The case part 30 is secured to the lower portion of the case part 22. The case part 29 and the case part 30 are located above the case part 26 and secured to the case part 26.

The case part 23 is connected to the case part 21 and the case part 22. The case part 23 extends in the left-right direction, bridging the lower portion of the case part 21 and the lower portion of the case part 22. The case part 24 is located above the case part 23. The case part 24 extends in the left-right direction, bridging the upper portion of the case part 21 and the upper portion of the case part 22. The case part 24 is connected to the case part 21, the case part 22, and the case part 25. As shown in FIG. 2, a cylindrical upper steering shaft 61 is inserted through the case part 24. A cylindrical lower steering shaft 62 is inserted through the case part 23. The drive shaft 7 is inserted through the upper steering shaft 61 and the lower steering shaft 62. The drive shaft 7 is coaxial with the upper steering shaft 61 and the lower steering shaft 62.

As shown in FIG. 3, the case part 28 is connected to the case part 21, the case part 22, and the case part 25. The case part 27 is connected to the case part 21, the case part 29, the case part 22, the case part 30, and the case part 26.

The upper case 20 is obtained by assembling together the case parts 21 to 30. There is no particular limitation on the manner of assembly of the case parts 21 to 30. Some or all of the case parts 21 to 30 may be attached together by fastening devices such as bolts or may be attached together by welding, or the like, without using fastening devices.

The support member 50 horizontally rotatably supports the outboard motor main unit 101. The support member 50 includes an upper support member 51 and a lower support member 52. The upper support member 51 supports the upper portion of the upper case 20. The lower support member 52 supports the lower portion of the upper case 20. The upper support member 51 and the lower support member 52 are separate from each other, and the lower support member 52 is spaced apart downward from the upper support member 51. The case part 24 is horizontally rotatably supported on the upper support member 51 by the upper steering shaft 61. The case part 23 is horizontally rotatably supported on the lower support member 52 by the lower steering shaft 62. The upper steering shaft 61 and the lower steering shaft 62 horizontally rotatably connect the upper case 20 to the support member 50. In the present preferred embodiment, the axes of the upper steering shaft 61 and the lower steering shaft 62 coincide with the axis 7*c* of the drive shaft 7. The outboard motor main unit 101 is able to rotate leftward and rightward about the axis 7*c*.

The attachment member 70 is attached to the rear portion of the hull 11. The support member 50 is connected by a tilt shaft 65 extending in the left-right direction to the attachment member 70. The tilt shaft 65 vertically rotatably links the support member 50 to the attachment member 70. Here, the attachment member 70 is vertically rotatably connected to the upper support member 51 by the tilt shaft 65.

As shown in FIG. 4, the attachment member 70 includes a left clamp bracket 70L and a right clamp bracket 70R located rightward of the left clamp bracket 70L. At least a portion of the upper support member 51 is sandwiched between the left clamp bracket 70L and the right clamp bracket 70R.

As will be described below, the tilt shaft 65 includes a left tilt shaft 65L and a right tilt shaft 65R (see FIG. 6). The upper support member 51 includes a left cover 54L that covers the left tilt shaft 65L and a right cover 54R that covers the right tilt shaft 65R. The left cover 54L is located leftward of the left clamp bracket 70L, and the right cover 54R is located rightward of the right clamp bracket 70R.

As shown in FIG. 2, a left reinforcement member 90L is connected to the upper support member 51 and the lower support member 52. The left reinforcement member 90L bridges the left portion of the upper support member 51 and the left portion of the lower support member 52. The left reinforcement member 90L includes a left upper connecting portion 91L connected to the upper support member 51 and a left lower connecting portion 92L connected to the lower support member 52. In the present preferred embodiment, the left upper connecting portion 91L is connected to the left cover 54L of the upper support member 51.

A right reinforcement member 90R is connected to the upper support member 51 and the lower support member 52 (see FIG. 5). FIG. 6 is a plan view schematically showing the left reinforcement member 90L, the right reinforcement member 90R, etc. The right reinforcement member 90R bridges the right portion of the upper support member 51 and the right portion of the lower support member 52. The right reinforcement member 90R includes the right upper connecting portion 91R connected to the upper support member 51, and the right lower connecting portion 92R connected to the lower support member 52. In the present preferred embodiment, as shown in FIG. 5, the right upper connecting portion 91R is connected to the right cover 54R of the upper support member 51.

Figure 6:
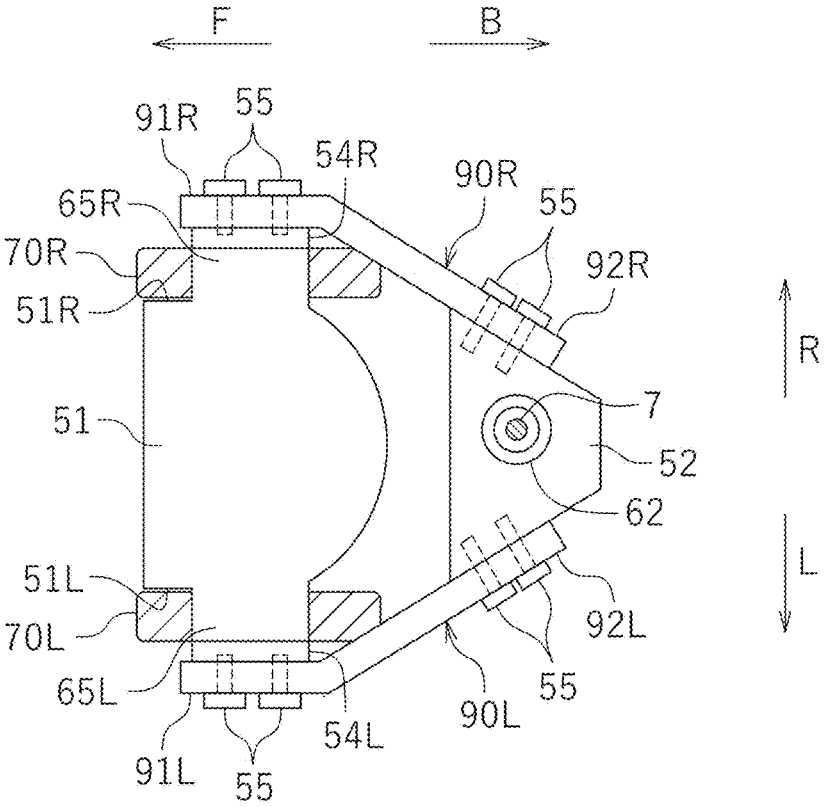
FIG. 6 is a plan view schematically showing the main portion of the outboard motor according to a preferred embodiment of the present invention.

As shown in FIG. 6, the upper support member 51 includes a left side portion 51L located rightward of the left clamp bracket 70L, and a right side portion 51R located leftward of the right clamp bracket 70R. A portion of or an entirety of the upper support member 51 is sandwiched between the left clamp bracket 70L and the right clamp bracket 70R. The left upper connecting portion 91L of the left reinforcement member 90L is located leftward of the left side portion 51L of the upper support member 51. The left upper connecting portion 91L is located leftward of the left clamp bracket 70L. The left lower connecting portion 92L is located below the left upper connecting portion 91L. The right upper connecting portion 91R of the right reinforcement member 90R is located rightward of the right side portion 51R of the upper support member 51. The right upper connecting portion 91R is located rightward of the right clamp bracket 70R. The right lower connecting portion 92R is located below the right upper connecting portion 91R.

The left tilt shaft 65L rotatably links together the left side portion 51L of the upper support member 51 and the left clamp bracket 70L. The right tilt shaft 65R rotatably links together the right side portion 51R of the upper support member 51 and the right clamp bracket 70R. In the present preferred embodiment, the left tilt shaft 65L and the right tilt shaft 65R are integral with the upper support member 51. The left tilt shaft 65L, the right tilt shaft 65R, and the upper support member 51 are a single element. Note, however, that there is no limitation thereto. The left tilt shaft 65L and the right tilt shaft 65R may be separate from the upper support member 51. The left tilt shaft 65L may be integral with or separate from the left clamp bracket 70L. The right tilt shaft 65R may be integral with or separate from the right clamp bracket 70R.

As shown in FIG. 2, the tilt cylinder 80 is connected to the attachment member 70 and the support member 50. The tilt cylinder 80 is vertically rotatably connected to the attachment member 70 and the support member 50. Specifically, the tilt cylinder 80 includes a rod 83 and a cylinder 84. A first link portion 81 is provided at the upper end portion of the rod 83. The first link portion 81 is vertically rotatably linked to the attachment member 70. A second link portion 82 is provided at the lower end portion of the cylinder 84. The second link portion 82 is vertically rotatably linked to the lower support member 52. The outboard motor main unit 101 rotates about the tilt shaft 65 as the rod 83 extends and retracts. In FIG. 2, the outboard motor main unit 101 rotates counterclockwise when the rod 83 extends, and rotates clockwise when the rod 83 retracts.

It is preferred that the left reinforcement member 90L and the right reinforcement member 90R are arranged so as to straddle in the up-down direction at least one of the first link portion 81 and the second link portion 82 of the tilt cylinder 80. That is, it is preferred that at least one of the first link portion 81 and the second link portion 82 of the tilt cylinder 80 is located below an upper end 90*t* of the left reinforcement member 90L and the right reinforcement member 90R and above a lower end 90*b* thereof.

In the present preferred embodiment, the left reinforcement member 90L and the right reinforcement member 90R are arranged so as to straddle in the up-down direction both of the first link portion 81 and the second link portion 82 of the tilt cylinder 80. That is, the first link portion 81 and the second link portion 82 of the tilt cylinder 80 are located below the upper end 90*t* of the left reinforcement member 90L and the right reinforcement member 90R and above the lower end 90*b* thereof.

As viewed from the side of the outboard motor 100, the left reinforcement member 90L and the right reinforcement member 90R are slanted relative to the drive shaft 7. The left lower connecting portion 92L of the left reinforcement member 90L is located rearward and below the left upper connecting portion 91L. The right lower connecting portion 92R of the right reinforcement member 90R is located rearward and below the right upper connecting portion 91R. The left reinforcement member 90L and the right reinforcement member 90R extend rearward and downward. Therefore, the left reinforcement member 90L and the right reinforcement member 90R are able to suitably support the load in the up-down direction and the front-rear direction. Note that while the left reinforcement member 90L and the right reinforcement member 90R are entirely slanted relative to the drive shaft 7 as viewed from the side of the outboard motor 100 in the present preferred embodiment, the left reinforcement member 90L and the right reinforcement member 90R may be partially slanted relative to the drive shaft 7.

As shown in FIG. 5, a portion of or an entirety of the left reinforcement member 90L preferably extends downward and rightward. A portion of or an entirety of the right reinforcement member 90R preferably extends downward and leftward. In other words, the left reinforcement member 90L preferably includes a slanted portion 93L extending downward and rightward, and the right reinforcement member 90R preferably includes a slanted portion 93R extending downward and leftward. In the present preferred embodiment, the entirety of the left reinforcement member 90L extends downward and rightward. The entirety of the right reinforcement member 90R extends downward and leftward.

While there is no particular limitation on the shape of the left reinforcement member 90L and the right reinforcement member 90R, the left reinforcement member 90L and the right reinforcement member 90R preferably have a plate shape, for example. The dimension of the left reinforcement member 90L and the right reinforcement member 90R in the left-right direction is smaller than that in the front-rear direction and that in the up-down direction. As shown in FIG. 2, the dimension of the left reinforcement member 90L and the right reinforcement member 90R in the front-rear direction is larger than the outer diameter of the cylinder 84 of the tilt cylinder 80. The left reinforcement member 90L and the right reinforcement member 90R are partly located forward of the axis of the tilt shaft 65. The left reinforcement member 90L includes bolt holes 95 through which bolts 55 (not shown in FIG. 2, see FIG. 6) are inserted to attach the left reinforcement member 90L to the left cover 54L. Although not shown in the figure, the right reinforcement member 90R similarly includes bolt holes. In addition to the bolt holes 95, the left reinforcement member 90L and the right reinforcement member 90R includes holes 94 that extend in the left-right direction. As opposed to the bolt holes 95, the holes 94 are always open without being closed. The holes 94 are provided in order to reduce the weight of the left reinforcement member 90L and the right reinforcement member 90R. While the number of holes 94 is four herein, there is no particular limitation on the number of holes 94.

The outboard motor 100 is configured as described above. Next, various advantageous effects of the outboard motor 100 according to the present preferred embodiment will be described.

While navigating the watercraft 10, a load in the lateral direction (lateral load) may be applied to a lower portion of the outboard motor main unit 101. For example, when the watercraft 10 turns, leftward or rightward water pressure may be applied to the propulsion unit 5. The propulsion unit 5 is supported by the upper case 20, and the upper case 20 is supported by the support member 50. When a lateral load is applied to the propulsion unit 5, the lateral load is transmitted to the upper case 20. A portion of the lateral load transmitted to the upper case 20 is transmitted to the support member 50. In the present preferred embodiment, the upper case 20 is supported by the upper support member 51 and the lower support member 52. Therefore, when a lateral load is applied to the upper case 20, a portion of the lateral load is transmitted to the upper support member 51 and the lower support member 52. Attempting to support the lateral load with only the upper support member 51 and the lower support member 52 results in a need to increase the mechanical strength of the upper support member 51 and the lower support member 52 against lateral loads, and thus increase the size and the weight of the upper support member 51 and the lower support member 52.

However, with the outboard motor 100 according to the present preferred embodiment, the left reinforcement member 90L and the right reinforcement member 90R are connected to the upper support member 51 and the lower support member 52. The support member 50 is reinforced by the left reinforcement member 90L and the right reinforcement member 90R. Particularly, the left upper connecting portion 91L of the left reinforcement member 90L is located leftward of the left side portion 51L of the upper support member 51, and the right upper connecting portion 91R of the right reinforcement member 90R is located rightward of the right side portion 51R of the upper support member 51. Therefore, with the left reinforcement member 90L and the right reinforcement member 90R, it is possible to efficiently increase the mechanical strength of the support member 50 against lateral loads. A portion of the lateral load that is transmitted from the propulsion unit 5 to the upper case 20 is transmitted from the lower support member 52 to the hull 11 via the left reinforcement member 90L, the right reinforcement member 90R, the upper support member 51, and the attachment member 70. A portion of the lateral load that is transmitted from the propulsion unit 5 to the upper case 20 is transmitted directly to the upper support member 51 from the lower support member 52. This reduces the lateral load applied to the upper case 20. It is possible to prevent an increase in size and weight of the upper case 20. Therefore, with the outboard motor 100 according to the present preferred embodiment, it is possible to increase the mechanical strength against lateral loads while preventing an increase in size and weight of the support member 50.

In the present preferred embodiment, as shown in FIG. 6, the left upper connecting portion 91L of the left reinforcement member 90L is located leftward of the left clamp bracket 70L, and the right upper connecting portion 91R of the right reinforcement member 90R is located rightward of the right clamp bracket 70R. The left upper connecting portion 91L is located farther leftward. The right upper connecting portion 91R is located farther rightward. Therefore, it is possible to more effectively increase the mechanical strength of the support member 50 against lateral loads.

As shown in FIG. 2, at least one of the first link portion 81 and the second link portion 82 of the tilt cylinder 80 is located below the upper end 90*t* of the left reinforcement member 90L and the right reinforcement member 90R and above the lower end 90*b* thereof. In the present preferred embodiment, the first link portion 81 and the second link portion 82 of the tilt cylinder 80 are located below the upper end 90*t* of the left reinforcement member 90L and the right reinforcement member 90R and above the lower end 90*b* thereof. Therefore, when a lateral load is applied to the propulsion unit 5, it is possible to prevent the lateral load from being transmitted to the tilt cylinder 80 via the upper case 20 and the support member 50. It is possible to prevent a large lateral load from being applied to the tilt cylinder 80. The upper ends 90*t* of the left reinforcement member 90L and the right reinforcement member 90R are located above the first link portion 81 of the tilt cylinder 80, and the lower ends 90*b* thereof are located below the second link portion 82 of the tilt cylinder 80. Thus, the dimension of the left reinforcement member 90L and the right reinforcement member 90R in the up-down direction is relatively large. Therefore, even if the dimension of the support member 50 in the up-down direction is relatively large, it is possible to sufficiently increase the mechanical strength of the support member 50 against lateral loads.

The left lower connecting portion 92L of the left reinforcement member 90L is located rearward of the left upper connecting portion 91L, and the right lower connecting portion 92R of the right reinforcement member 90R is located rearward of the right upper connecting portion 91R. The left reinforcement member 90L and the right reinforcement member 90R extend downward and rearward. Therefore, the left reinforcement member 90L and the right reinforcement member 90R are able to sufficiently support a load in the left-right direction (i.e., a lateral load), and also support a load in the up-down direction and the front-rear direction. Thus, it is possible to increase the mechanical strength of the support member 50.

As shown in FIG. 5, the left reinforcement member 90L includes the slanted portion 93L extending downward and rightward. The right reinforcement member 90R includes the slanted portion 93R extending downward and leftward. The left reinforcement member 90L has a significant mechanical strength against loads upward and leftward. The right reinforcement member 90R has a significant mechanical strength against loads upward and rightward. Therefore, it is possible to increase the mechanical strength of the support member 50 against lateral loads.

While the support member 50 may be an integral member, it includes in the present preferred embodiment the upper support member 51 and the lower support member 52 that are separate from each other. The lower support member 52 is spaced apart downward from the upper support member 51. The support member 50 includes no member that links together the upper support member 51 and the lower support member 52. Therefore, as compared with a case in which the support member 50 is an integral member, it is possible to reduce the size and the weight of the support member 50. The left upper connecting portion 91L of the left reinforcement member 90L and the right upper connecting portion 91R of the right reinforcement member 90R are connected to the upper support member 51, and the left lower connecting portion 92L of the left reinforcement member 90L and the right lower connecting portion 92R of the right reinforcement member 90R are connected to the lower support member 52. Thus, although the support member 50 includes the upper support member 51 and the lower support member 52, which are separate from each other, it is possible with the left reinforcement member 90L and the right reinforcement member 90R to sufficiently increase the mechanical strength of the support member 50 against lateral loads.

While there is no particular limitation on the shape of the left reinforcement member 90L and the right reinforcement member 90R, the left reinforcement member 90L and the right reinforcement member 90R each preferably have a plate shape, for example, in the present preferred embodiment. Therefore, it is possible to easily manufacture the left reinforcement member 90L and the right reinforcement member 90R.

The left reinforcement member 90L and the right reinforcement member 90R include the holes 94 that extend in the left-right direction. Therefore, it is possible to reduce the weight of the left reinforcement member 90L and the right reinforcement member 90R.

While preferred embodiments of the present invention have been described above, the preferred embodiments are merely illustrative, and various alternative preferred embodiments are possible. Next, alternative preferred embodiments of the present invention will be described briefly.

Figure 7:
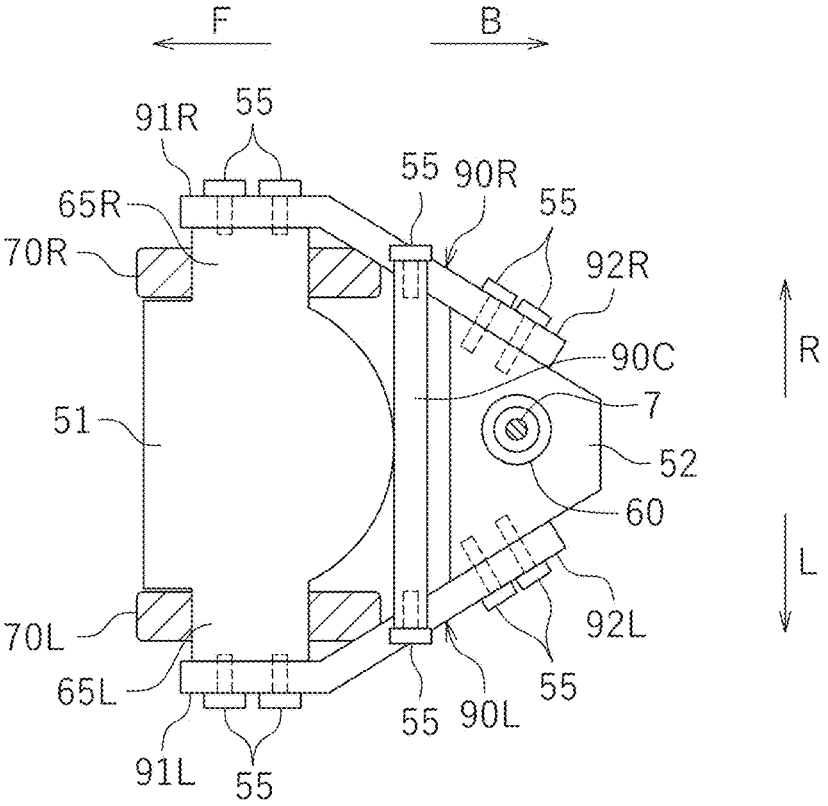
FIG. 7 is a plan view schematically showing the main portion of the outboard motor according to an alternative preferred embodiment of the present invention.

As shown in FIG. 7, the outboard motor 100 may include a lateral reinforcement member 90C connected to the left reinforcement member 90L and the right reinforcement member 90R. The lateral reinforcement member 90C bridges the left reinforcement member 90L and the right reinforcement member 90R. The lateral reinforcement member 90C extends in the left-right direction. Note, however, that there is no limitation thereto. The lateral reinforcement member 90C may extend leftward and rearward or may extend rightward and rearward. The lateral reinforcement member 90C may extend downward and rearward or may extend upward and rearward. The lateral reinforcement member 90C may extend straight or may be curved. The lateral reinforcement member 90C may be curved or may be bent, and there is no particular limitation on the method of connecting the lateral reinforcement member 90C to the left reinforcement member 90L and the right reinforcement member 90R. As shown in FIG. 7, the lateral reinforcement member 90C may be connected to the left reinforcement member 90L and the right reinforcement member 90R by fastening devices such as the bolts 55, for example, or may be connected thereto by welding, or the like, without using fastening devices. By providing the lateral reinforcement member 90C on the left reinforcement member 90L and the right reinforcement member 90R, it is possible to further increase the mechanical strength of the support member 50 against lateral loads.

Figure 8:
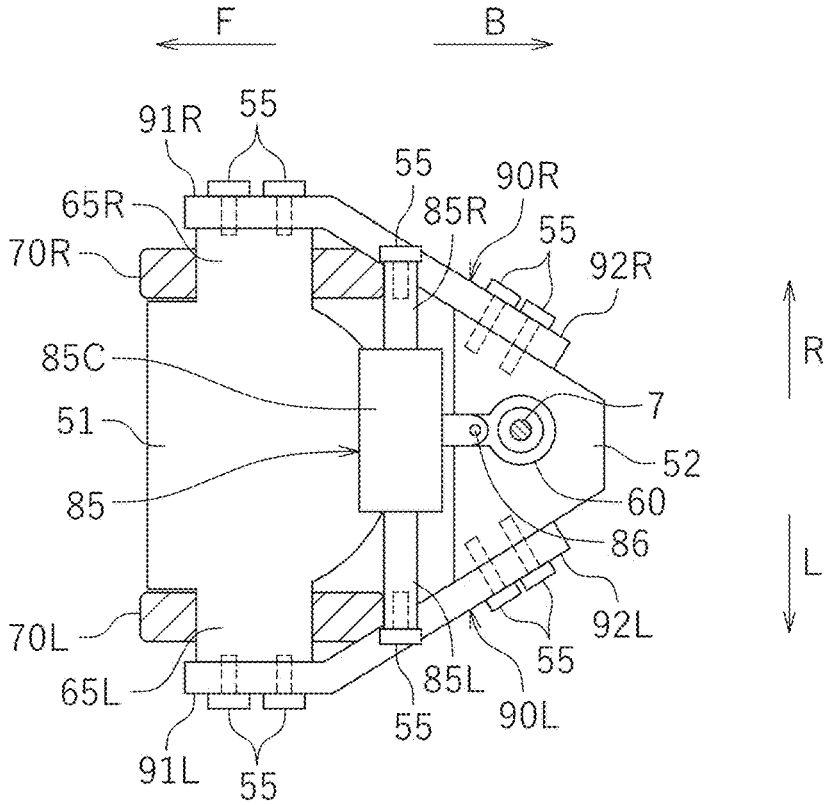
FIG. 8 is a plan view schematically showing the main portion of the outboard motor according to an alternative preferred embodiment of the present invention.

As shown in FIG. 8, the outboard motor 100 may include the steering actuator 85 to rotate the outboard motor main unit 101 leftward and rightward. Here, the steering actuator 85 includes a cylinder 85C, a left rod 85L extending leftward from the cylinder 85C, and a right rod 85R extending rightward from the cylinder 85C. The cylinder 85C and a steering shaft 60 are linked together by a link shaft 86 extending in the vertical direction. In FIG. 8, the steering shaft 60 rotates clockwise when the left rod 85L extends and the right rod 85R retracts, and the steering shaft 60 rotates counterclockwise when the right rod 85R extends and the left rod 85L retracts. Note that the cylinder 85C may be linked to the upper steering shaft 61 or may be linked to the lower steering shaft 62. A middle steering shaft (not shown) that links together the upper steering shaft 61 and the lower steering shaft 62 may be provided between the upper steering shaft 61 and the lower steering shaft 62, and the middle steering shaft may be linked to the cylinder 85C.

At least a portion of the steering actuator 85 is preferably located between the left reinforcement member 90L and the right reinforcement member 90R. Then, the space between the left reinforcement member 90L and the right reinforcement member 90R may be used as an installation space for the steering actuator 85. It is possible to reduce the size of the outboard motor 100.

The steering actuator 85 may also define and function as a lateral reinforcement member. For example, the left end portion of the left rod 85L may be connected to the left reinforcement member 90L, and the right end portion of the right rod 85R may be connected to the right reinforcement member 90R. Then, the left rod 85L, the cylinder 85C, and the right rod 85R define and function as a lateral reinforcement member bridging the left reinforcement member 90L and the right reinforcement member 90R. Thus, by using the steering actuator 85 as a lateral reinforcement member, it is possible to increase the mechanical strength of the support member 50 against lateral loads without increasing the number of components.

Figure 9:
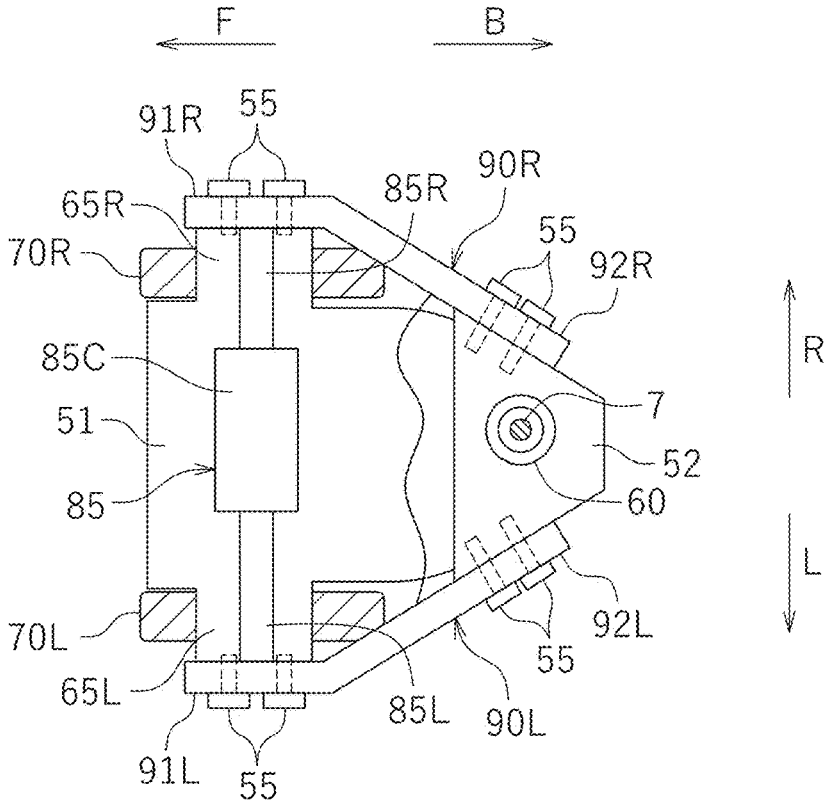
FIG. 9 is a plan view schematically showing the main portion of the outboard motor according to an alternative preferred embodiment of the present invention.

As shown in FIG. 9, the left rod 85L and the left tilt shaft 65L may be coaxial with each other, and the right rod 85R and the right tilt shaft 65R may be coaxial with each other. The steering actuator 85 may be connected to the left upper connecting portion 91L of the left reinforcement member 90L and to the right upper connecting portion 91R of the right reinforcement member 90R. Note that FIG. 9 does not show a mechanism to link together the cylinder 85C and the steering shaft 60.

Figure 10:
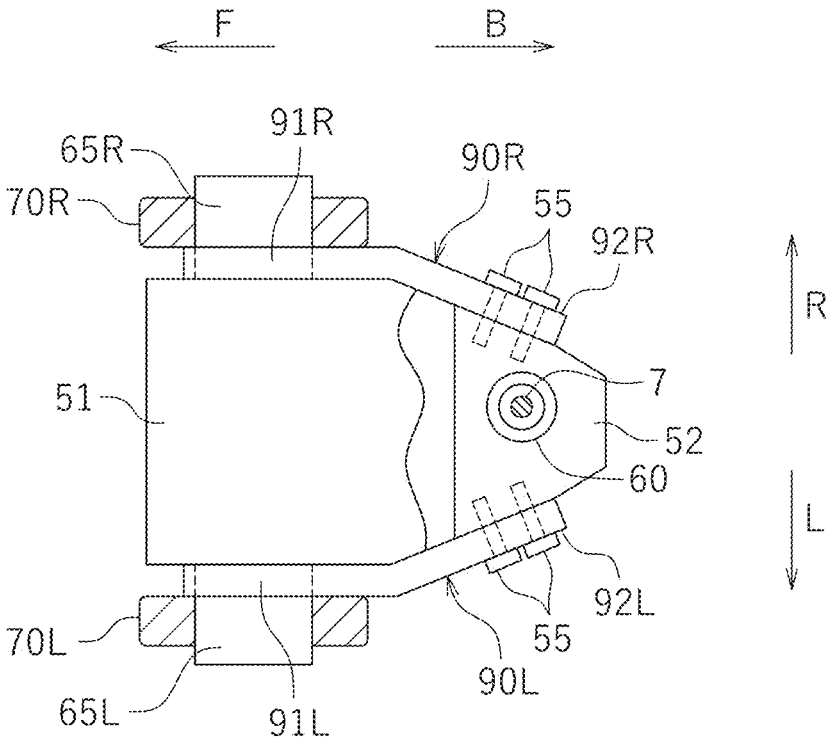
FIG. 10 is a plan view schematically showing the main portion of the outboard motor according to an alternative preferred embodiment of the present invention.
Figure 11:
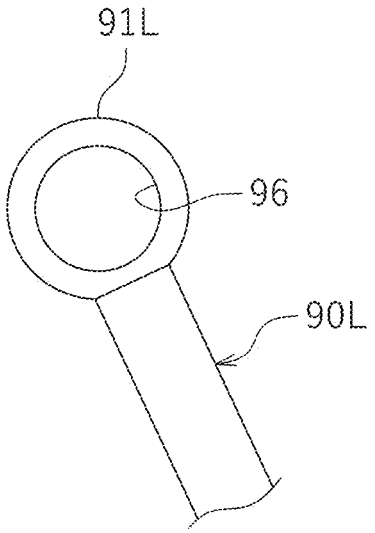
FIG. 11 is a side view showing a left upper connecting portion of a left reinforcement member according to an alternative preferred embodiment of the present invention.

As shown in FIG. 10, the left upper connecting portion 91L of the left reinforcement member 90L may be attached to the left tilt shaft 65L. The right upper connecting portion 91R of the right reinforcement member 90R may be attached to the right tilt shaft 65R. As shown in FIG. 11, the left upper connecting portion 91L of the left reinforcement member 90L includes a hole 96 through which the left tilt shaft 65L is inserted. Similarly, the right upper connecting portion 91R of the right reinforcement member 90R may include a hole through which the right tilt shaft 65R is inserted. By inserting the left tilt shaft 65L through the hole 96 of the left upper connecting portion 91L and inserting the right tilt shaft 65R through the hole of the right upper connecting portion 91R, it is possible to easily attach the left reinforcement member 90L and the right reinforcement member 90R to the upper support member 51.

As shown in FIG. 10, the left upper connecting portion 91L of the left reinforcement member 90L may be located rightward of the left clamp bracket 70L. The right upper connecting portion 91R of the right reinforcement member 90R may be located leftward of the right clamp bracket 70R. Alternatively, the left upper connecting portion 91L may be located leftward of the left clamp bracket 70L and the right upper connecting portion 91R may be located rightward of the right clamp bracket 70R.

Figure 12:
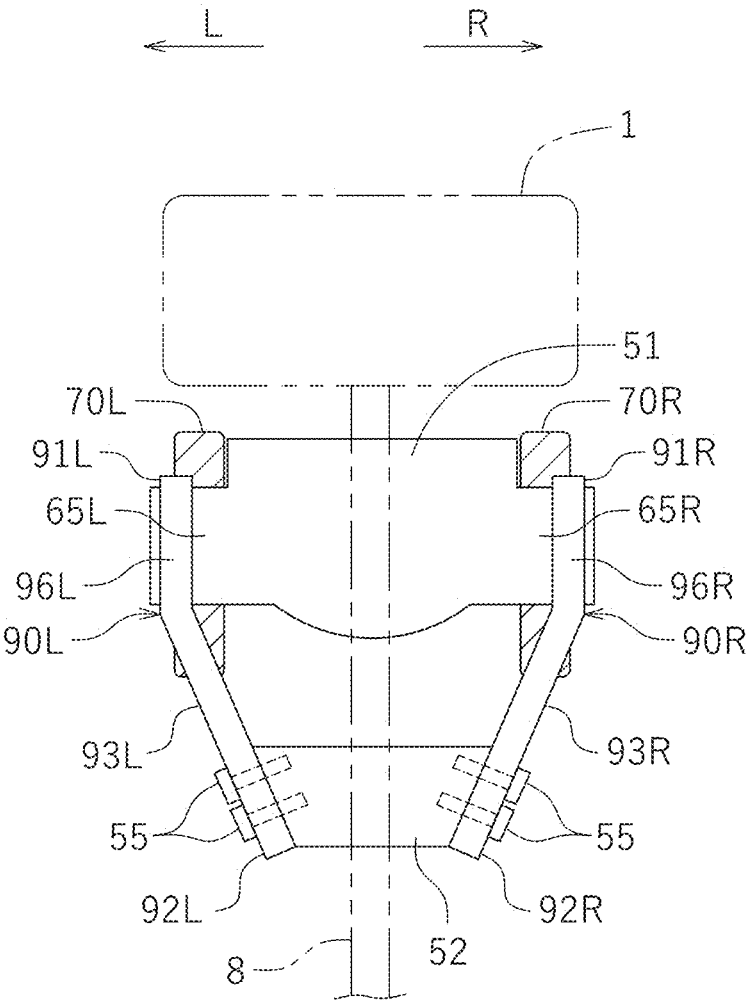
FIG. 12 is a back view schematically showing the main portion of the outboard motor according to an alternative preferred embodiment of the present invention.

As shown in FIG. 12, a portion of the left reinforcement member 90L may extend in the vertical direction and another portion thereof may extend downward and rightward. A portion of the right reinforcement member 90R may extend in the vertical direction and another portion may extend downward and leftward. In other words, the left reinforcement member 90L may include a vertical portion 96L extending in the vertical direction, and the slanted portion 93L extending downward and rightward from the lower end of the vertical portion 96L. The right reinforcement member 90R may include a vertical portion 96R extending in the vertical direction, and the slanted portion 93R extending downward and leftward from the lower end of the vertical portion 96R.

The left upper connecting portion 91L of the left reinforcement member 90L may be connected to any of the left cover 54L, the left tilt shaft 65L, and the left side portion 51L of the upper support member 51, or may be connected to a portion of the upper support member 51 other than the left side portion 51L. The right upper connecting portion 91R of the right reinforcement member 90R may be connected to any of the right cover 54R, the right tilt shaft 65R, and the right side portion 51R of the upper support member 51, or may be connected to a portion of the upper support member 51 other than the right side portion 51R.

While the left reinforcement member 90L and the right reinforcement member 90R preferably have a plate shape in the preferred embodiments described above, there is no particular limitation thereto. For example, the left reinforcement member 90L and the right reinforcement member 90R may have a rod shape. The left reinforcement member 90L and the right reinforcement member 90R may or may not be shaped in left-right symmetry.

The holes 94 of the left reinforcement member 90L and the right reinforcement member 90R are not always necessary. The holes 94 may be absent.

The case part 21 and the case part 22 of the upper case 20 do not need to oppose each other in the left-right direction. The case part 21 and the case part 22 of the upper case 20 may oppose each other in the front-rear direction. The upper case 20 does not need to have a frame structure obtained by assembling together the case parts 21 to 30. The upper case 20 may have a closed tubular shape.

As shown in FIG. 2, in a preferred embodiment described above, the tilt cylinder 80 is arranged so that the rod 83 extends upward and forward. However, there is no limitation on the arrangement of the tilt cylinder 80. For example, the tilt cylinder 80 may be arranged so that the rod 83 extends upward and rearward. For example, the lower end portion of the cylinder 84 may be vertically rotatably linked to the attachment member 70, and the upper end portion of the rod 83 may be vertically rotatably linked to the upper support member 51. In this case, the lower end portion of the cylinder 84 defines and functions as the first link portion, and the upper end portion of the rod 83 defines and functions as the second link portion. In this preferred embodiment or the preferred embodiment described above (see FIG. 2), the positions of the rod 83 and the cylinder 84 may be switched around.

The terms and expressions used herein are used for explanation purposes and should not be construed as being restrictive. It should be appreciated that the terms and expressions used herein do not eliminate any equivalents of features illustrated and mentioned herein, but include various modifications falling within the claimed scope of the present invention. The present invention may be embodied in many different forms. The present disclosure is to be considered as providing examples of the principles of the present invention. These examples are described herein with the understanding that such examples are not intended to limit the present invention to preferred embodiments described herein and/or illustrated herein. Hence, the present invention is not limited to the preferred embodiments described herein. The present invention includes any and all preferred embodiments including equivalent elements, modifications, omissions, combinations, adaptations and/or alterations as would be appreciated by those skilled in the art on the basis of the present disclosure. The limitations in the claims are to be interpreted broadly based on the language included in the claims and not limited to examples described in the present specification or during the prosecution of the application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an outboard motor main unit including an engine, a propulsion unit located below the engine, and a drive shaft connected to the engine and the propulsion unit;

an attachment to be attached to a hull; and a support vertically rotatably connected to the attachment and horizontally rotatably supporting the outboard motor main unit; wherein the attachment includes a left clamp bracket and a right clamp bracket located rightward of the left clamp bracket;

the support includes a left side located rightward of the left clamp bracket and a right side located leftward of the right clamp bracket, and is sandwiched between the left clamp bracket and the right clamp bracket;

the outboard motor further comprises:

a left tilt shaft vertically rotatably linking together the left side of the support and the left clamp bracket;

a right tilt shaft vertically rotatably linking together the right side of the support and the right clamp bracket;

a left reinforcement including a left upper connector connected to the support and located leftward of the left side of the support, and a left lower connector connected to the support and located below the left upper connector;

a right reinforcement including a right upper connector connected to the support and located rightward of the right side of the support, and a right lower connector connected to the support and located below the right upper connector; and a tilt cylinder including a first link vertically rotatably linked to the attachment and a second link vertically rotatably linked to the support; wherein both of the first link and the second link of the tilt cylinder are located below an upper end and above a lower end of the left reinforcement and the right reinforcement.

2. The outboard motor according to claim 1, wherein the left lower connector of the left reinforcement is located rearward of the left upper connector; and the right lower connector of the right reinforcement is located rearward of the right upper connector.

3. The outboard motor according to claim 1, wherein the support includes an upper support sandwiched between the left clamp bracket and the right clamp bracket, and a lower support spaced apart and below the upper support;

the left upper connector of the left reinforcement and the right upper connector of the right reinforcement are connected to the upper support; and the left lower connector of the left reinforcement and the right lower connector of the right reinforcement are connected to the lower support.

4. The outboard motor according to claim 1, wherein the left upper connector of the left reinforcement is located leftward of the left clamp bracket; and the right upper connector of the right reinforcement is located rightward of the right clamp bracket.

5. The outboard motor according to claim 1, wherein the left upper connector of the left reinforcement is attached to the left tilt shaft; and the right upper connector of the right reinforcement is attached to the right tilt shaft.

6. The outboard motor according to claim 1, wherein the left reinforcement includes a slanted portion extending downward and rightward; and the right reinforcement includes a slanted portion extending downward and leftward.

7. The outboard motor according to claim 1, further comprising a lateral reinforcement connected to the left reinforcement and the right reinforcement and bridging the left reinforcement and the right reinforcement.

8. The outboard motor according to claim 7, wherein the lateral reinforcement extends in a left-right direction.

9. The outboard motor according to claim 1, further comprising a steering actuator to rotate the outboard motor main unit leftward and rightward; wherein at least a portion of the steering actuator is located between the left reinforcement and the right reinforcement.

10. The outboard motor according to claim 1, wherein a portion of or an entirety of the left reinforcement and the right reinforcement extends downward and rearward and is slanted relative to the drive shaft as viewed from a side.

11. The outboard motor according to claim 1, wherein the left reinforcement and the right reinforcement are plate-shaped or substantially plate-shaped.

12. The outboard motor according to claim 1, wherein the left reinforcement and the right reinforcement include holes that extend in a left-right direction.

* * * * *